US008919354B2

(12) United States Patent
Davis

(10) Patent No.: US 8,919,354 B2
(45) Date of Patent: Dec. 30, 2014

(54) MAGNETIC HEADBAND

(71) Applicant: Jody Davis, Ipswich, MA (US)

(72) Inventor: Jody Davis, Ipswich, MA (US)

( * ) Notice: Subject to any disclaimer, the term of this patent is extended or adjusted under 35 U.S.C. 154(b) by 0 days.

(21) Appl. No.: 13/837,486

(22) Filed: Mar. 15, 2013

(65) Prior Publication Data

US 2013/0291886 A1 Nov. 7, 2013

Related U.S. Application Data

(60) Provisional application No. 61/643,585, filed on May 7, 2012.

(51) Int. Cl.
*A45D 8/00* (2006.01)
*A45D 8/36* (2006.01)

(52) U.S. Cl.
CPC ..... *A45D 8/36* (2013.01)
USPC ..... 132/275

(58) Field of Classification Search
USPC ..... 132/273–284; 24/303; 63/40, 900
See application file for complete search history.

(56) References Cited

U.S. PATENT DOCUMENTS

| | | | | |
|---|---|---|---|---|
| 4,975,987 | A | 12/1990 | Teachout et al. | |
| 5,427,123 | A | 6/1995 | Odenthal | |
| 5,901,381 | A | 5/1999 | Nelson | |
| 5,974,634 | A * | 11/1999 | Eisenpresser | 24/303 |
| 6,170,088 | B1 | 1/2001 | Tate | |
| 6,289,903 | B1 | 9/2001 | Haufler | |
| 6,401,726 | B1 * | 6/2002 | Sonstegard | 132/275 |
| 6,513,167 | B1 | 2/2003 | Cheng | |
| 6,594,871 | B2 | 7/2003 | Hoffman | |
| 6,748,602 | B1 | 6/2004 | Barnes | |
| 7,322,212 | B2 | 1/2008 | Golove et al. | |
| 7,588,331 | B2 | 9/2009 | Burnstein | |
| 7,591,554 | B2 | 9/2009 | Guerrero | |
| 7,793,518 | B1 | 9/2010 | Holleman | |
| 7,937,966 | B2 | 5/2011 | Golove et al. | |
| 8,069,538 | B2 | 12/2011 | Wilcox | |
| 2009/0032044 | A1 | 2/2009 | Grimm | |
| 2011/0219587 | A1 * | 9/2011 | Nizan et al. | 24/303 |
| 2012/0125360 | A1 * | 5/2012 | Hill et al. | 132/275 |

OTHER PUBLICATIONS

[No Author Listed] "How It Works—Patent Pending." Banteez. Oct 12, 2011. 3 pages. http://www.banteez.com/how-it-works/. Last Accessed Feb. 21, 2013.
[No Author Listed] "Shimmery Elastic Headband—You Choose 1." LookinSnappy. Product posted on Etsy.com. Product sold Aug. 21, 2012. 2 pages. http://www.etsy.com/transaction/91637117?. Last Accessed.

(Continued)

*Primary Examiner* — Rachel Steitz
(74) *Attorney, Agent, or Firm* — Nutter McClennen & Fish LLP

(57) ABSTRACT

Methods and devices are provided for various headbands and one or more decorative features configured to be magnetically attached to the headbands. In certain embodiments, a decorative feature can magnetically attach to any part of a headband via a magnetic element seated within a magnetic element pocket of the decorative feature. The magnetic element can be securely contained within the magnetic element pocket by a closure. In certain embodiments the decorative feature can also optionally include a sleeve that can slide over the headband and more securely attach the decorative feature to the headband.

4 Claims, 3 Drawing Sheets

(56) References Cited

OTHER PUBLICATIONS

Golueke, "Anika: Interchangeable Magnetic Headband." VintageCollision. Product posted on Etsy.com. Product sold Oct. 13, 2011. http://www.etsy.com/listing/86795627/anika-interchangeable-magnetic-headband".
Golueke, "Gabrielle: Interchangeable Magnetic Headband." Vintage Collision. Product posted on Etsy.com. Product sold Dec. 11, 2011. 2 pages. http://www.etsy.com/listing/82149075/gabrielle-interchangeable-magnetic. Last accessed Feb. 21, 2013.
Hill, "MOGO is Charming Girls." The Giggle Guide. Jan. 14, 2010. 2 pages. http://thegiggleguide.com/grapevine/2010-01/mogo-charming-girls. Last Accessed Feb. 20, 2013.
Olin, "Magnetic interchangeable hair accessories.. Create style on a budget." Style to Styles. Aug. 19, 2010. 3 pages. http://styletostyles.blogspot.com/2010/08/magnetic-interchangeable-hair.html. Last Accessed Feb. 20, 2013.
Seagrave, "Boujy Flower." Aug. 15, 2011. 19 pages. http://www.boujyflower.com/. Last Accessed Feb. 21, 2013.
[No Author Listed] "Magnetic Interchangeable Flower." The Ribbon Retreat Biog. Jun. 29, 2011. 9 pages. http://www.theribbonretreat.com/blog/magnetic-interchangeable-flower.html. Last Accessed Feb. 21, 2013.
[No Author Listed] "About Mogo." Mogo: We just click! 2011. 2 pages. http://mogocharm.com/about_mogo/. Last Accessed Feb. 21, 2013.
[No Author Listed] "Ribbon Headband." Alex Toys. 2013. 1 page. http://www.alextoys.com/product/723W. Last Accessed Feb. 21, 2013.
[No Author Listed] "Inner Changeable Hard Headband." Glam R Girls Boutique; Posh Accessories for Your Little Princess. 2008. 2 pages. http://glamrgirlsboutique.com/item_187/Inner-Changeable-Hard-Headband.htm. Last Accessed Feb. 21, 2013.
[No Author Listed] "6-Piece Interchangeable Headband Set by Lori Greiner." QVC. 2011. 5 pages. http://www.qvc.com/6piece-Interchangeable-Headband-Set-by-Lori-Greiner.product.H193654.html?&cookie=set. Last Accessed Feb. 21, 2013.

* cited by examiner

MAGNETIC HEADBAND

RELATED APPLICATIONS

This application claims priority to U.S. Provisional Application No. 61/643,585, filed May 7, 2012, entitled "Magnetic Headbands," which is incorporated by reference herein.

FIELD OF THE INVENTION

The present invention relates generally to headband devices, and in particular to magnetic headbands with magnetically attached decorative features.

BACKGROUND OF THE INVENTION

People commonly wear items such as hats, hair clips, and headbands for functional reasons, such as to keep hair out of the eyes, and for aesthetic reasons, such as to complement a wardrobe.

In the case of headbands, countless varieties are known, including basic designs that primarily serve a functional purpose, and more complex designs that can include aesthetic features. Aspects of the headband that can be modified to provide aesthetically pleasing features include, e.g., varying the shape, size, or color, adding a pattern or design to the external surface, varying the materials used to construct the headband, and adding one or more ornaments to the external surface.

To achieve a further degree of variety and customization, some headbands have ornaments that are removably attached by corresponding attachment features of the headband and the ornament, e.g. a snap, Velcro, or magnets. When the corresponding attachment features are affixed to an external surface of the ornament and/or the headband, one disadvantage is that the visibility of the attachment features can detract from the appearance of the ornament and/or the headband. Also, if the attachment feature is not adequately attached to the ornament, it may loosen from and fall off the ornament, resulting in an unreliable product, and also potentially creating a choking hazard if the headband and ornament are used by, or are otherwise accessible to, a child. In addition, certain attachment features, e.g., magnets, may not provide an adequate force to securely attach the ornament to the headband.

Accordingly, there remains a need for improved magnetic headbands.

SUMMARY OF THE INVENTION

The present invention generally provides various methods and devices for magnetically attaching a decorative feature to a headband. In one embodiment, a device is provided having an elongate member with one or more magnetic element portions and a decorative feature magnetically coupled to one of the magnetic element portions. The decorative feature can have a magnetic element pocket with a magnetic element disposed therein. The magnetic element portion of the headband and the magnetic element of the decorative feature can be formed from, for example, a permanent magnet or a material formed from a ferromagnetic material.

The device can have a variety of configurations, but in one exemplary embodiment, the decorative feature includes a sleeve coupled to a proximal surface of the decorative feature. The sleeve can be formed from, for example, elastic material, fabric, rubber, plastic, or metal. In use, the sleeve is adapted to slide over the elongate member and to securely fasten the decorative feature to the elongate member. In another embodiment, the magnetic element pocket has a distal portion and a proximal portion and a closure, where the closure is configured to securely enclose the magnetic element within the magnetic element pocket, and in some embodiments, the magnetic element pocket is permanently closed by the closure. In an exemplary embodiment, the closure includes at least one of stitching, adhesive, a zipper, and velcro. In some exemplary embodiments the elongate member is formed from a ferromagnetic material. In other embodiments, the elongate member can be, for example, a headband, a hair pin, a hair clip, a clothing pin or a clasp. In yet another embodiment, at least one of the magnetic element portions can extend along at least half of the length of the elongate member so that a plurality of the decorative features can be simultaneously magnetically attached along the length of the curved elongate member.

In another embodiment, a decorative ornament is provided having a decorative distal portion and a proximal portion. The proximal portion of the decorative ornament can include a magnetic element container with a magnetic element disposed therein that is adapted to be magnetically attracted to magnetic material, and a closure that closes the magnetic element container. The closure can include, for example, thread sewn along an edge of the magnetic element container, an adhesive, a zipper, and Velcro. And the magnetic element can be formed from, for example, a permanent magnet or a ferromagnetic material.

The decorative ornament can have a number of variations. For example, the proximal portion of the decorative ornament can include a sleeve. The sleeve can be formed from, for example, elastic material, fabric, rubber, plastic, or metal. In use, the sleeve can be adapted to surround a portion of a headband passed through the sleeve to securely fasten the decorative ornament to the headband. For another example, the closure can permanently close the magnetic element container.

BRIEF DESCRIPTION OF THE DRAWINGS

The invention will be more fully understood from the following detailed description taken in conjunction with the accompanying drawings, in which.

DETAILED DESCRIPTION OF THE INVENTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The present invention generally provides various headbands with magnetically attached decorative features. In one embodiment, a decorative feature can be magnetically attached to a headband via a magnetic element seated within a magnetic element pocket of the decorative feature, such that the magnetic element does not appear on the surface of the decorative feature. The magnetic element can be securely contained within the magnetic element pocket by a closure, where the closure can be thread sewn around a perimeter of the magnetic element pocket to permanently close the pocket. The closure can also include an adhesive to further secure the magnetic element pocket. In some embodiments, the decorative feature can have a sleeve attached thereto that can be configured to slide over the headband and to more securely attach the decorative feature to the headband. The headband can be formed from one or more magnetic materials that are magnetically attracted to the magnetic element in the decorative feature. In use, as described more fully below, decorative features can be interchangeably matched with headbands by magnetically attaching one or more decorative features to any portion of a headband.

Figure 1:
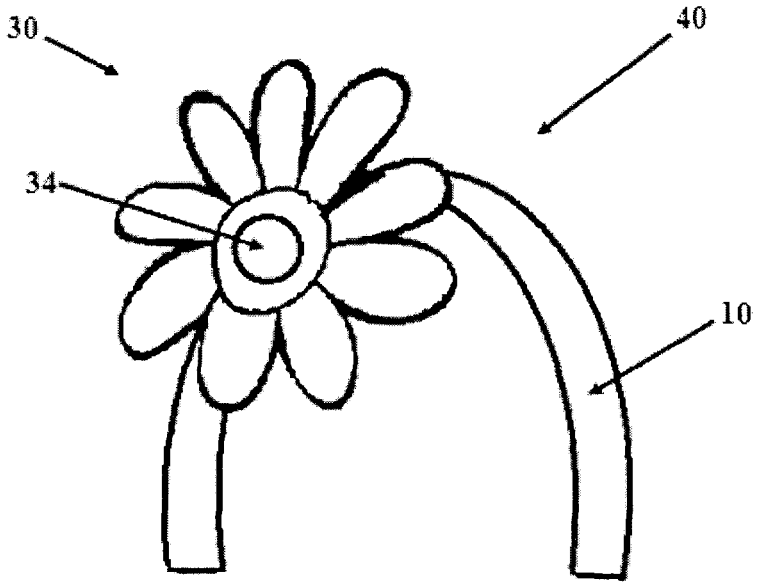
FIG. 1 is a perspective view of a magnetic headband system.

FIG. 1 illustrates magnetic headband system 40 that can include a decorative feature 30 magnetically attached to a headband 10. In the illustrated embodiment, the headband 10 is formed from one or more magnetic materials and the decorative feature 30 includes a magnetic element pocket 34 that has a magnetic element 36 (not shown) enclosed therein, such that the decorative feature 30 can be selectively attached to and removed from the headband 10 by a user. In use, the magnetic headband system 40 can be completely customizable, where one or more decorative features 30 can be magnetically attached to any portion of the headband 10, resulting in a customizable magnetic headband where decorative features can be quickly and easily interchanged and moved to different locations on the surface of the headband 10. Although the headband 10 of FIG. 1 has only one decorative feature 30 attached thereto, the headband 10 can have any number of decorative features 30 simultaneously attached thereto, or can be worn with no decorative features attached.

Figure 2:
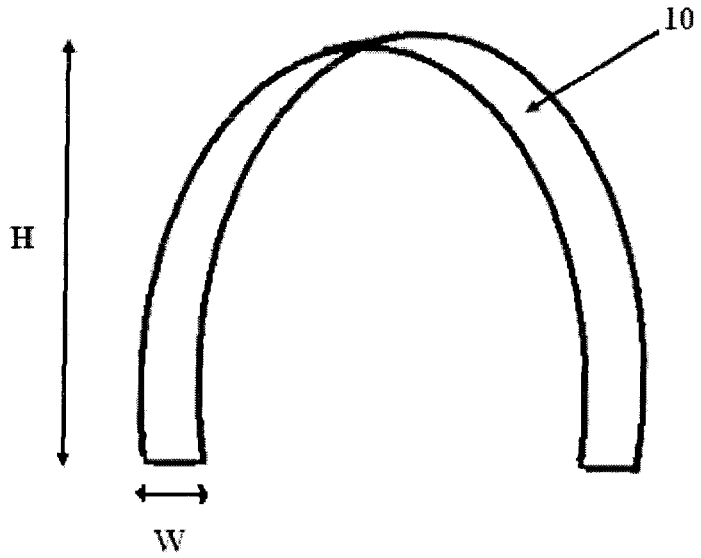
FIG. 2 is a perspective view of one embodiment of a magnetic headband.

FIG. 2 illustrates the magnetic headband 10 that can be worn on a person's head, and can be configured to be magnetically attracted to a decorative feature in one exemplary embodiment. While headbands for use with the magnetic headband system 40 can have a variety of sizes, shapes, and configurations, the illustrated headband 10 is an elongate member formed in the shape of an arch and constructed from a substantially rigid and elastic material that allows the headband 10 to expand to fit around a person's head. While the width W of the headband 10 in the illustrated embodiment is substantially constant along an entire length of headband 10, in other embodiments the width W can vary. For example, the width W of the headband 10 can be smaller along end portions of the arch and wider along the peak of the arch. As will be discussed more fully below, a larger width W and/or a greater height H of the headband 10 can result in a larger surface area, which in some embodiments can improve the integrity of the magnetic coupling between a decorative feature and the headband. The headband 10 can also include any number of additional features for improving the fit of the headband 10 to a person's head, such as the addition of soft material at various locations on a proximal surface of the headband 10, facing a person's head, to improve comfort and fit, the addition of comb-like teeth elements that can be inserted underneath layers of hair to more securely position the headband 10 on a person's head, and/or the addition of various types of fabric to improve the feel and appearance of the headband 10.

The headband 10 can be formed from one or more magnetic materials that are magnetically attracted to other magnetic material. The one or more magnetic materials can include either a material that possesses a persistent magnetic field, such as a permanent magnet, or a material that is attracted to a permanent magnet. By way of non-limiting example, a permanent magnet can include iron-based and neodymium-based magnets. Rare earth magnets, such as neodymium-based magnets, are very strong and a relatively small neodymium magnet can securely attach a relatively large decorative element to a headband. By way of non-limiting example, materials that are attracted to permanent magnets include ferromagnetic materials. There are numerous types of ferromagnetic materials, all of which are within the scope of the present invention. Non-limiting examples of elements commonly found in ferromagnetic materials are iron, copper, and nickel. In the illustrated embodiment, the entire headband 10 is formed from an iron-based alloy that is magnetically attracted to a permanent magnet, which can be advantageous because it allows for the magnetic decorative feature 30 to be placed anywhere along the surface of headband 10.

Figure 3:
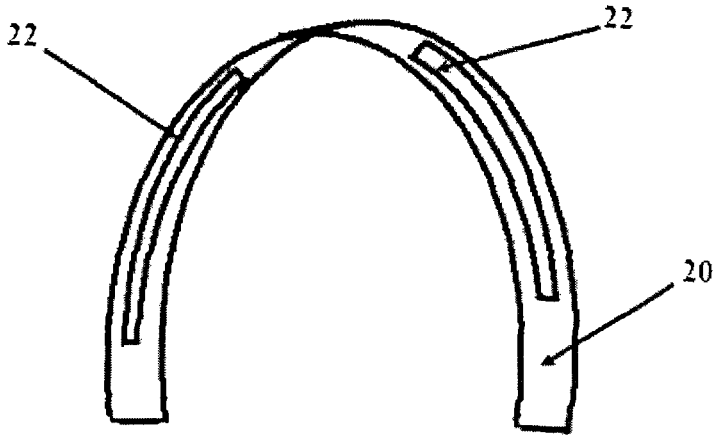
FIG. 3 is a perspective view of another embodiment of a headband with magnetic portions.

A headband for use with the magnetic headband system 40 can be of any shape and size, and can be constructed from a variety of materials or combinations of materials. For example, an additional embodiment of a magnetic headband 20 for use with the magnetic headband system 40 is illustrated in FIG. 3. The headband 20 can have magnetic portions 22 that can be formed from one or more magnetic materials and remaining portions of the headband 20 can be formed from either a magnetic material or some other material. The magnetic portions 22 can allow for greater flexibility in material choice for the remaining portions of the headband 20. For example, the remaining portions of the headband 20 can be formed from a low cost, lightweight plastic and the magnetic portions 22 can be incorporated into the headband 20 to provide attachment regions for magnetic decorative features. The magnetic portions 22 can be coupled to the headband 20 by any way known in the art. Non-limiting examples include bonding, gluing, riveting, soldering, or welding the magnetic portions 22 to either an outer or an inner surface of the headband 20 or to a recess formed in the headband 20, or by embedding the magnetic portions 22 within the headband 20, for example, via an injection molding or insert molding process. While the illustrated embodiment has two rectangular magnetic portions 22, there can be any number of magnetic portions that can have any size and shape. For example, the headband 20 can have a single magnetic portion that extends across an entire length of the headband 20 and can have a width that is the same or narrower than a width of the headband 20, or the headband 20 can have a plurality of small magnetic portions dispersed along the length of the headband 20. While FIGS. 1 and 2 illustrate a headband, any device that can couple to a magnetic decorative element is within the scope of the present invention. By way of non-limiting example, hair clips, hair pins, clothing pins, clothing, or accessories such as handbags, that have portions formed from one or more magnetic materials can be used as a base for one or more of the decorative features disclosed herein.

Figure 4:
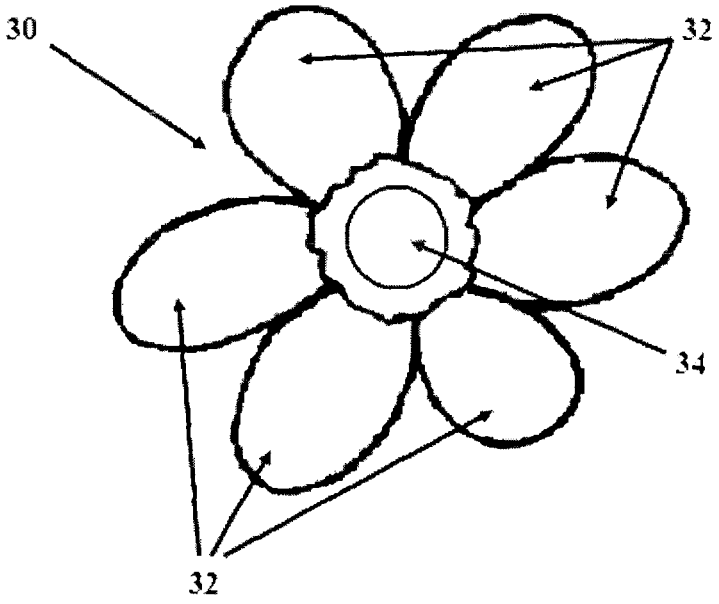
FIG. 4 is a top view of a decorative feature with a magnetic element pocket.

FIG. 4 illustrates one exemplary embodiment of a decorative feature 30 that is configured to be magnetically attached to a base, such as the magnetic headbands 10, 20 of FIGS. 2 and 3. For the sake of illustration, the configuration and use of the decorative feature 30 will be described in conjunction with the headband 10. In the illustrated embodiment, the decorative feature 30 includes a magnetic element pocket 34 formed in or attached to a central portion of the decorative feature 30. As will be discussed more fully below, the magnetic element pocket 34 can securely seat a magnetic element 36 (not shown) which can be configured to magnetically couple the decorative feature 30 to the headband 10. By containing the magnetic element 36 in the magnetic element pocket 34, rather than attaching the magnetic element 36 to an external surface of the decorative feature 30, the magnetic element 36 can be more securely attached to the decorative feature 30. Containing the magnetic element 36 within the magnetic element pocket 34 can also give the decorative feature 30 a more appealing look, since the magnetic element 36 is hidden within the pocket 34, and can protect the magnetic element 36 from wear. While the decorative feature 30 includes a single, circular magnetic element pocket 34 located in the center of the decorative feature 30, the decorative feature 30 can have any number of magnetic element pockets of any number of sizes and shapes, located along any portion of the decorative feature 30. In the illustrated embodiment, the decorative feature 30 and the magnetic element pocket 34 are made from fabric and are in the form of a flower that has flower petals 32. While the decorative feature 30 is in the shape of a flower, this is for illustrative purposes only, and decorative features for use with the magnetic headband assembly 40 can have any number of shapes, sizes, and configurations. For example, the decorative features can be in the shape of any flower with any number of petals arranged in any configuration. The decorative features can also be in the form of something other than a flower, e.g., geometric shapes, fruits, animals, landscapes, cityscapes, and one or more letters, and can be made from any number of materials including one or more of a plastic, a metal, and a fabric.

Figure 5:
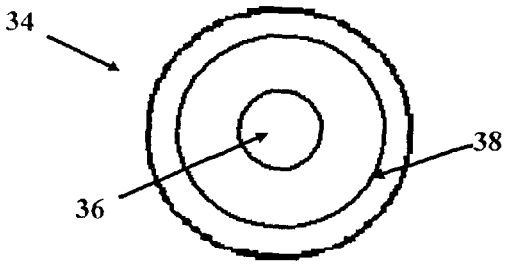
FIG. 5 is a top view with a top layer removed of the magnetic element pocket of the decorative feature of FIG. 4.
Figure 6:
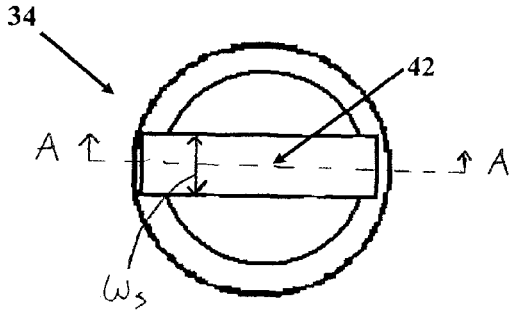
FIG. 6 is a bottom view of the magnetic element pocket of FIG. 5.
Figure 7:
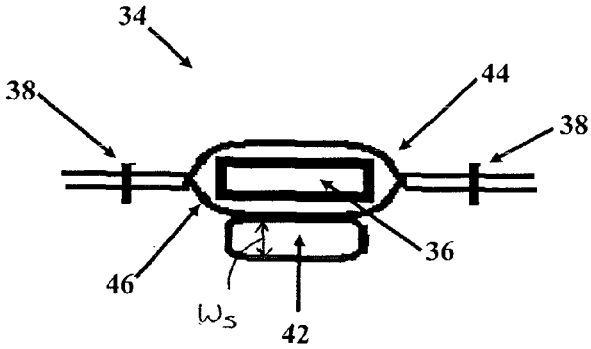
FIG. 7 is a cross-sectional side view of the magnetic element pocket of FIG. 5 taken along line A-A.

FIGS. 5-7 illustrate additional views of the magnetic element pocket 34. FIG. 5 is a top-view of the magnetic element pocket 34 with a top layer removed. In this embodiment, the magnetic element pocket 34 includes the magnetic element 36 seated and sealed therein by a closure 38. As will be discussed more fully below, the closure 38 can be configured to securely contain the magnetic element 36 within the pocket 34. The magnetic element 36 can be formed from one or more magnetic materials that are magnetically attracted to the magnetic headband 10. As discussed above, magnetic material can include either a material that possesses a persistent magnetic field, such as a permanent magnet, or a material that is attracted to a permanent magnet. If both the magnetic headband 10 and the magnetic element 36 are formed from a permanent magnet material, the poles of the magnets can be oriented so they attract each other, e.g., a north pole of the magnetic element 36 in the decorative element 30 should be oriented toward a south pole of a magnet in the headband 10. Alternatively, either the magnetic element 36 or the headband 10 can be formed from a permanent magnet, and the other can be formed from a material that is attracted to a permanent magnet. For example, in the illustrated embodiment, the magnetic element 36 can be a neodymium permanent magnet and the headband 10 can be formed from a ferromagnetic material, such as an iron alloy. While the magnetic element 36 is shown as having a circular cross section, magnetic elements for use with the magnetic headband system 40 can have any size and shape, and the magnetic element pocket 34 can have any number of the magnetic elements 36 seated therein.

As mentioned above, the closure 38 securely contains the magnetic element 36 within the magnetic element pocket 34 by securely closing the magnetic element pocket 34. While the closure 38 can have a variety of configurations, in the illustrated embodiment the closure 38 includes a seam stitched around a perimeter of magnetic element pocket 34 and can also include an adhesive to further secure the magnetic element 36 within the pocket 34. The adhesive can be applied to an area surrounding the closure 38, or it can be applied to an entire inner surface of the magnetic element pocket 34 to more securely contain the magnetic element 36. Any substance that can function as an adhesive in conjunction with the materials used to construct the magnetic element pocket 34 can be used. Non limiting examples include any commonly available fabric glue, upholstery glue, common household glue, spray-on fabric adhesive, and iron-on adhesives. By using both stitching and an adhesive for the closure 38, the magnetic element 36 can be securely positioned within the magnetic element pocket 34 which can result in a tamper-proof magnetic element pocket 34, which can be desirable for decorative features designed for children. By securely enclosing the magnetic element 36 within the magnetic element pocket 34, it is significantly more difficult for a young child to open the magnetic element pocket 34 and/or inadvertently ingest the magnetic element 36.

The magnetic element pocket 34 can have any number of variations. For example, the magnetic element pocket 34 can have two or more closures 38 to more securely contain the magnetic element 36 therein. Other mechanisms for permanently enclosing the magnetic element 36 in the magnetic element pocket 34 can be used, for example, solvent bonding, soldering, welding, and rivets. In addition, the closure 38 can be non-permanent, for example, for decorative features not designed for young children, or where having the ability to remove the magnetic element 36 might be desirable. The ability to remove the magnetic element 36 can be desirable for, e.g., substituting a permanent magnet magnetic element 36 for a ferromagnetic magnetic element 36, sharing the magnetic element 36 among multiple decorative features, washing the decorative feature 30, etc. Non limiting examples of non-permanent closures 38 include Velcro, snaps, a zipper, and latches.

FIG. 6 illustrates the magnetic element pocket 34 having a sleeve 42 attached thereto. The sleeve 42 can be removably or permanently affixed to the magnetic element pocket 34 to more securely attach the decorative feature 30 to the headband 10 by providing a mechanical attachment to the headband 10 in addition to the magnetic attachment provided by the magnetic element 36. In use, the decorative feature 30 can be attached to the headband 10 by sliding the headband 10 through an opening 44 (not shown) of the sleeve 42. The sleeve 42 can be configured such that it is capable of sliding along the headband 10 but remains fixed on a portion of the headband 10 when no force is applied to the sleeve 42 or to the attached decorative feature 30. Thus, the decorative feature 30 can be positioned anywhere along the headband 10 by sliding it along the headband 10. The sleeve 42 can have a variety of sizes and can be constructed from a variety of materials. For example, a width $W_S$ of the sleeve 42 can be narrow when affixed to a small decorative feature and wide when affixed to a large decorative feature. A diameter $D_S$ of the opening 44 of the sleeve 42 can also vary, but must be sufficiently large to accommodate the headband 10 therein. The sleeve 42 can be formed from a variety of materials, e.g., one or more of a fabric, an elastic material, a rubber, a plastic, and a metal. Forming the sleeve 42 from one or more elastic materials can be advantageous because it allows the sleeve 42 to be used with a wider range of headband sizes. The additional mechanical attachment provided by the sleeve 42 can be useful for any decorative feature and for any headband, but can be particularly useful for attaching a decorative feature to a thinner headband, where there may be less surface area of magnetic material on the headband for magnetically coupling to the magnetic element 36. In addition, the mechanical attachment provided by the sleeve 42 can be advantageous for providing a longer useful life of the magnetic headband system 40 in cases where the permanent magnet in either the headband 10 or decorative feature 30 begins to weaken.

FIG. 7 illustrates a cross sectional side view of the magnetic element pocket 34 taken along line A-A of FIG. 6. The magnetic element pocket 34 can include a distal portion 44, a proximal portion 46 having the sleeve 42 attached thereto, and the magnetic element 36 embedded between the distal portion 44 and the proximal portion 46. The distal portion 44 can be continuous with the proximal portion 46, or the distal portion 44 can be separate from the proximal portion 46 prior to application of the closure 38. In either embodiment, the distal portion 44 and the proximal portion 46 can be closed around the magnetic element 36 by the closure 38 to form a secure pocket. As described above, the closure 38 can include a stitching around a perimeter of the magnetic element pocket 34 that passes through both the distal portion 44 and the proximal portion 46. Where the distal portion 44 and the proximal portion 46 are separate elements, the closure 38 can mate the distal portion 44 to the proximal portion 46. The closure 38 can also include an adhesive (not shown) that can be spread across a distal-facing surface of the proximal portion 46 or a proximal-facing surface of the distal portion 44, or both. The adhesive can be spread across the entire surface of the distal portion 44 and the proximal portion 46, or a smaller region around a perimeter of the distal portion 44 and the proximal portion 46. As discussed above, the closure 38 can include a variety of mechanisms to create either a permanent closure where the magnetic element 36 is permanently contained within magnetic element pocket 34, or a temporary closure, where the magnetic element 36 is selectively removable from magnetic element pocket 34. While the distal portion 44 and proximal portion 46 of the illustrated embodiment are two pieces of fabric having substantially the same dimensions, as discussed above, the magnetic element pocket 34 can have a variety of other configurations. By way of non-limiting example, the proximal portion 46 can have a diameter that is larger than a diameter of the distal portion 44 such that the distal portion 44 can be attached to the proximal portion 46 via the closure 38 and an outer perimeter of the proximal portion 46 that extends beyond the diameter of the distal portion 44 can be attached to a proximal-facing surface of the decorative feature 30. In another aspect, the distal portion 44 can form a distal surface of the decorative feature 30.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A decorative ornament comprising:

a decorative distal portion and a proximal portion;

the proximal portion including a magnetic element container with a magnetic element enclosed therein, wherein the magnetic element is configured to be magnetically attracted to magnetic material of a hairpiece, and a sleeve being configured to surround a portion of the hairpiece passed therethrough, and to securely fasten the decorative ornament to the hairpiece; and a closure that permanently closes the magnetic element container, the closure comprising at least one adhesive material.

2. The decorative ornament of claim 1, wherein the magnetic element is at least one of a permanent magnet and a ferromagnetic material.

3. The device of claim 1, wherein the sleeve is formed from at least one of elastic material, fabric, rubber, plastic, and metal.

4. The device of claim 1, wherein the hairpiece is at least one of a headband, a hair pin, a hair clip, a clothing pin and a clasp.

* * * * *